US007569993B2

(12) United States Patent
Ito et al.

(10) Patent No.: US 7,569,993 B2
(45) Date of Patent: Aug. 4, 2009

(54) GAS DISCHARGE TUBE WITH DISCHARGE PATH LIMITING MEANS

(75) Inventors: Yoshinobu Ito, Hamamatsu (JP); Koji Matsushita, Hamamatsu (JP); Masaki Ito, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 564 days.

(21) Appl. No.: 10/512,887

(22) PCT Filed: Apr. 30, 2003

(86) PCT No.: PCT/JP03/05551

§ 371 (c)(1),
(2), (4) Date: Jun. 10, 2005

(87) PCT Pub. No.: WO03/094199

PCT Pub. Date: Nov. 13, 2003

(65) Prior Publication Data

US 2005/0231119 A1 Oct. 20, 2005

(30) Foreign Application Priority Data

Apr. 30, 2002 (JP) ..... 2002-128768

(51) Int. Cl.
*H01J 17/02* (2006.01)
*H01J 61/02* (2006.01)

(52) U.S. Cl. ..... 313/611; 313/609; 313/610; 313/612

(58) Field of Classification Search ..... 313/609–613, 313/623, 634, 637–638, 626, 622, 639, 641, 313/542–544, 590, 581, 103 R, 239, 492, 313/243, 929, 292, 231.31, 231.01, 595–633, 313/529, 567, 538, 540; 250/214 VT
See application file for complete search history.

(56) References Cited

U.S. PATENT DOCUMENTS 3,501,665 A * 3/1970 Heinz et al. ..... 313/146
3,508,106 A * 4/1970 Lajos ..... 313/231.61
5,191,260 A 3/1993 Kawai et al.
5,327,049 A * 7/1994 Smolka et al. ..... 315/248

(Continued)

FOREIGN PATENT DOCUMENTS

EP 0 473 378 A2 3/1992

(Continued)

*Primary Examiner*—Sikha Roy
*Assistant Examiner*—Jose M Diaz
(74) *Attorney, Agent, or Firm*—Drinker Biddle & Reath LLP

(57) ABSTRACT

In a gas discharge tube there is carried out narrowing of the discharge path with cooperation of the first opening 20 and second opening 12 in order to obtain higher luminance of light. Further, in order to maintain excellent starting-properties of a lamp even if the discharge path is narrowed, a predetermined voltage is applied to a second discharge path limit portion 11 externally. Thereby, a positive or active starting discharge is produced in such a manner as to pass through the first opening 20. Further, the second opening 12 is comprised of not only a straight section 13 extending in a direction of an optical axis Y, but also a spread section 14 extending from an end portion of the straight section 13 toward the first opening 20.

37 Claims, 13 Drawing Sheets

U.S. PATENT DOCUMENTS

| | | | | |
|---|---|---|---|---|
| 5,552,669 | A | 9/1996 | Ikedo et al. | |
| 5,587,625 | A | 12/1996 | Ikedo et al. | |
| 5,619,101 | A | 4/1997 | Ikedo et al. | |
| 5,633,563 | A | 5/1997 | Ikedo et al. | |
| 5,646,487 | A | 7/1997 | Ikedo et al. | |
| 5,684,363 | A | 11/1997 | Ikedo et al. | |
| 5,698,945 | A * | 12/1997 | Ikedo et al. | 313/613 |
| 5,886,470 | A * | 3/1999 | Smolka | 313/637 |
| 6,380,663 | B1 | 4/2002 | Ikedo et al. | |
| 6,381,014 | B1 * | 4/2002 | Platzer et al. | 356/316 |
| 6,531,821 | B1 | 3/2003 | Ikedo et al. | |
| 6,559,576 | B1 | 5/2003 | Ikedo et al. | |
| 6,573,655 | B1 | 6/2003 | Ikedo et al. | |
| 6,586,866 | B1 | 7/2003 | Ikedo et al. | |
| 6,741,036 | B1 | 5/2004 | Ikedo et al. | |
| 6,956,326 | B2 * | 10/2005 | Kawai et al. | 313/609 |
| 2004/0021419 | A1 * | 2/2004 | Ito et al. | 313/637 |
| 2004/0041523 | A1 | 3/2004 | Kawai et al. | |
| 2004/0046506 | A1 | 3/2004 | Kawai et al. | |

FOREIGN PATENT DOCUMENTS

| | | | |
|---|---|---|---|
| EP | 0 685 874 | A1 | 12/1995 |
| EP | 0 700 071 | A2 | 3/1996 |
| EP | 1 143 486 | A1 | 10/2001 |
| EP | 1 154 462 | A1 | 11/2001 |
| JP | 54-141780 | Y2 | 10/1979 |
| JP | 4-341749 | A | 11/1992 |
| JP | 05-159749 | A | 6/1993 |
| JP | 06-215734 | A | 8/1994 |
| JP | 06-310101 | A | 11/1994 |
| JP | 07-288106 | A | 10/1995 |
| JP | 07-326324 | A | 12/1995 |
| JP | 10-064479 | A | 3/1998 |
| WO | WO 0241358 | A1 * | 5/2002 |
| WO | 03/030208 | A1 | 4/2003 |
| WO | 03/094199 | A1 | 11/2003 |

* cited by examiner

GAS DISCHARGE TUBE WITH DISCHARGE PATH LIMITING MEANS

TECHNICAL FIELD

The present invention relates to a gas discharge tube used as a light source for a spectroscope, a chromatography, or the like.

BACKGROUND ART

There is disclosed as a prior art pertaining to the related technical field a gas (deuterium) discharge tube in Japanese Patent Laid-Open (Tokukai) No. H06-310101 publication. In a gas (deuterium) discharge tube described in this publication, there are arranged two metal partition walls within the discharge path between an anode and a cathode, wherein each of the metal partition walls is provided with small holes, whereby the discharge path is caused to be narrowed. As a result, it is made possible to obtain light with a high luminance by means of the small holes on the discharge path. Further, provision of three or more metal partition walls could lead to a further higher luminance. The smaller holes are made, the higher luminance of light there can be obtained.

DISCLOSURE OF THE INVENTION

In the conventional gas discharge tube described above, however, there are problems as follows. That is, no voltage is applied to each metal partition wall, wherein small holes of each metal partition wall are used merely for narrowing the discharge path. Although in the above-described conventional gas discharge tube, accordingly with certainty the small holes of each metal partition wall could be used for narrowing the discharge path, so as to enhance luminance, there must be increased a discharge starting voltage to the greater extent, as the small holes are made smaller and smaller, as also described in this publication, with the result that there is a marked restriction on the diameter of the small holes or the number of metal partition walls.

The present invention has been made in order to solve the above-described problems, and an object thereof is to provide a gas discharge tube excellent in starting properties (facilitating to start arc discharge) while achieving enhancement of luminance.

According to the present invention there is provided the gas discharge tube wherein a gas is enclosed in a sealed envelope, and a light is emitted outward from a light emitting window of the sealed envelope by producing a discharge between a anode portion and cathode portion both disposed in the sealed envelope, comprising: a first discharge path-limit portion, arranged in a midway of a discharge path between the anode portion and the cathode portion, and provided with a first opening for narrowing the discharge path; a second discharge path-limit portion, arranged in a midway of the discharge path between the first discharge path-limit portion and the anode portion, and provided with a second opening having a straight section for narrowing the discharge path a diameter of which is constant and which extends in a direction of an optical axis, and a spread section a diameter of which increases in size from an end portion of the straight section on the side of the anode portion toward the first opening and which extends in the direction of the optical axis.

In the gas discharge tube, in case where light with high luminance is to be created, it is insufficient to simply provide plural stages of the discharge path limit portion for narrowing discharge path, wherein there are caused difficulties in generation of discharge at the time of lamp starting not only due to increase in the number of discharge path limit portions, but also due to reduced diameters of openings. Therefore, in order to improve starting properties of a lamp, there is need to generate a remarkably large potential difference between the cathode portion and the anode portion. As a result, it has been confirmed in an experiment that the service life of the lamp is shortened. Such being the case, in the gas discharge tube according to the present invention, there is carried out narrowing of the discharge path with cooperation of the first opening and the second opening in order to obtain higher luminance of light. Further, in order to maintain excellent starting properties of a lamp even if the discharge path is narrowed, a predetermined voltage is applied to the second discharge path limit portion from the outside. Thereby, there is generated a positive or active starting discharge capable of passing through the first opening. In addition, the second opening is comprised of not only a straight section extending in the direction of the optical axis but also a spread section extending from the end portion of the straight section toward the first opening, and the spread section has a function of not only improving the starting properties of the lamp, but also forming an arc ball whereas the straight section has a function of improving a plasma density. Thereby, discharge at the time of start is facilitated in the second discharge path limit portion. As a result, there is achieved a rapid start of discharge between the cathode portion and the anode portion, which contributes to a proper generation of an arc ball after lightened.

Further, it is preferable that the length of the straight section of the second discharge path limit portion is set larger than the length of the spread section in the direction of the optical axis. The longer the straight section is set, the higher the plasma density can be enhanced. Further, the longer the spread section is set, the more stable generation of an arc ball is made possible. By setting the length of the straight section larger than that of the spread section on taking into account such circumstances enables to produce a proper arc ball at the spread section, while enhancing the density of plasma produced at the straight section.

Furthermore, it is preferable that the length of the spread section in the direction of the optical axis is equal to or larger than the diameter of the straight section. By adopting such a constitution, a stable arc ball can be produced at the second opening.

Moreover, it is preferable that the first opening of the first discharge path limit portion has the spread section extending in the direction of the optical axis such that the diameter of thereof on the side of the cathode portion is larger than the diameter of thereof on the side of the anode portion. By adopting such a constitution, discharge can be converged with ease at the first opening, so that an arc ball can be generated at this portion securely.

Further, it is preferable that an electrically insulating portion is arranged between the first discharge path limit portion and the second discharge path limit portion. By adopting such a constitution, the first discharge path limit portion and the second discharge path limit portion can be respectively set to different potentials so that starting properties is improved.

Furthermore, it is preferable that the gas discharge tube further comprises a third discharge path limit portion which is arranged in a midway of the discharge path between second discharge path limit portion and the anode portion, in such a manner as to be provided with a third opening for narrowing the discharge path. Thereby further higher luminance of light is to be attained with cooperation of respective openings of the respective discharge path limit portions.

Moreover, it is preferable that the third opening comprises not only a straight section, for narrowing the discharge path, extending in the direction of the optical axis with an equal diameter, but also an spread section extending in the direction of the optical axis such that a diameter thereof increases from an end portion of the straight section on the side of the anode portion toward the second opening. The spread section has a function of improving the starting properties of the lamp and generating an arc ball, whereas the straight section has a function of improving the plasma density.

Further, it is preferable that the length of the straight section of the third discharge path limit portion is set larger than the length of the spread section of the third discharge path limit portion in the direction of the optical axis. This enables to produce a proper arc ball at the spread section while increasing the density of plasma produced at the straight section in the third opening.

Moreover, it is preferable that the length of the spread section of the third discharge path limit portion in the direction of the optical axis is equal to or larger than the diameter of the straight section of the third discharge path limit portion. By adopting such a constitution, a stable arc ball can be produced at the third opening.

In addition, it is preferable that an electrically insulating portion is arranged between the second discharge path limit portion and the third discharge path limit portion. By adopting such a constitution, the second discharge path limit portion and the third discharge path limit portion can be respectively set to different potentials, so that the starting properties can be improved.

BEST MODE FOR CARRYING OUT THE INVENTION

Preferred embodiments of a gas discharge tube according to the present invention will be explained in detail below with reference to the drawings.

First Embodiment

Figure 1:
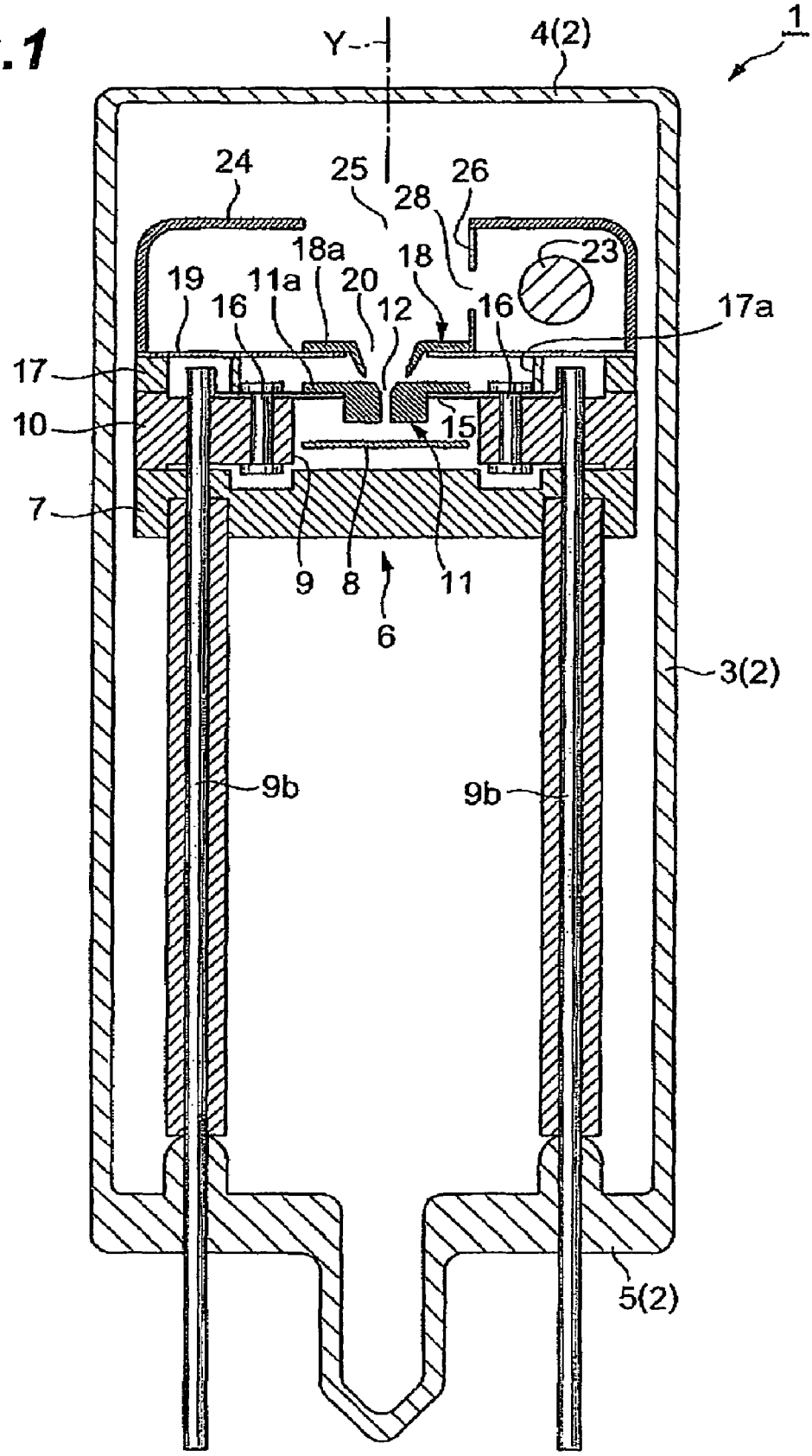
FIG. 1 is a sectional view showing a first embodiment of a gas discharge tube according to the present invention.
Figure 2:
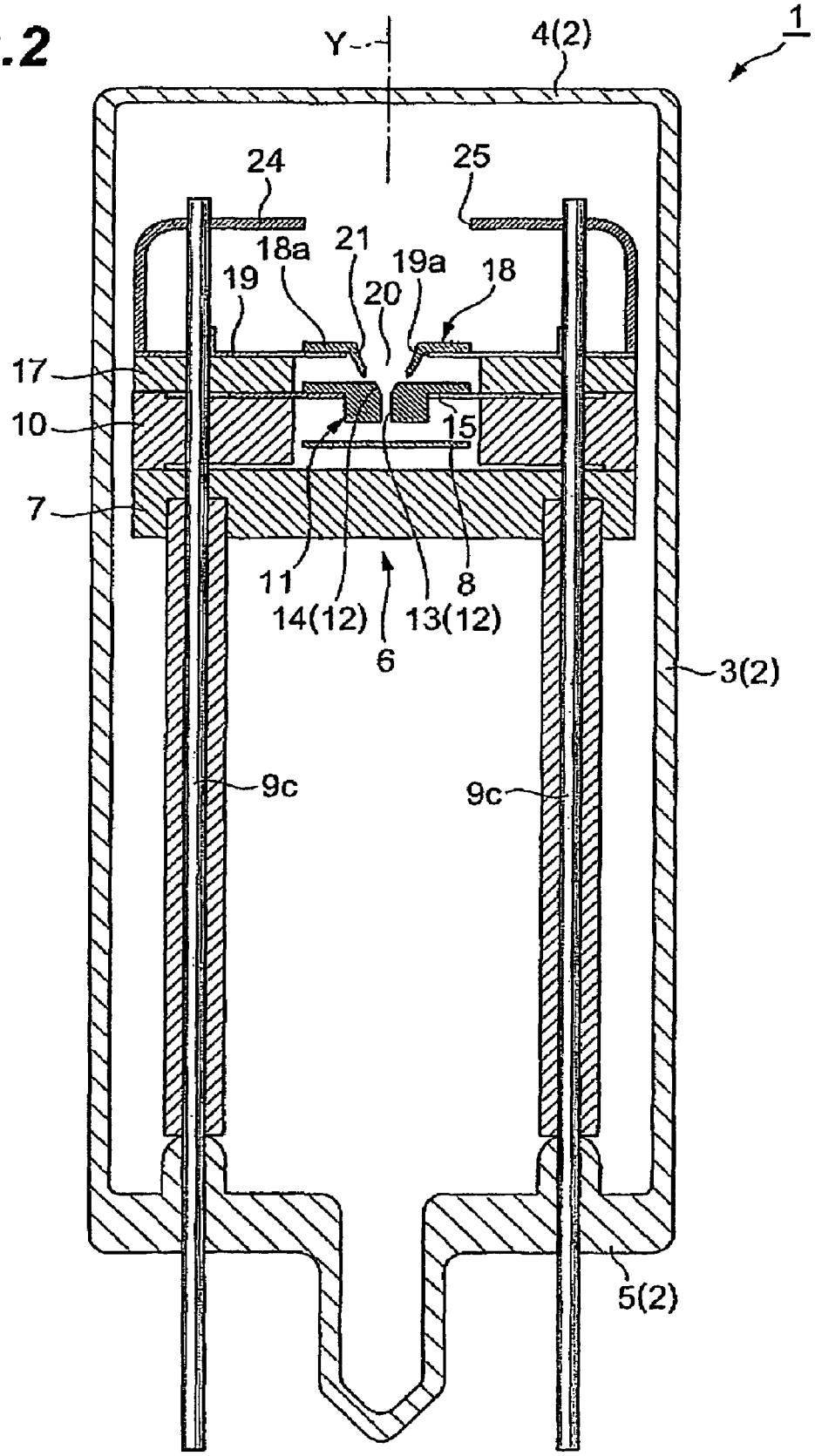
FIG. 2 is a vertical sectional view of the gas discharge tube shown in FIG. 1.

As shown in FIG. 1 and FIG. 2, a gas discharge tube 1 is a deuterium lamp of a head on type. The discharge tube 1 has a sealed envelope 2 made of glass in which deuterium gas has been enclosed in an amount of about several hundreds Pa, and the sealed envelope 2 comprises a light emitting window 4 which seals one side of a cylindrical side tube 3 and a stem 5 which seals the other side of the side tube 3. Then, a light emitting assembly 6 is accommodated in the sealed envelope 2.

This light emitting assembly 6 has a disc-like first supporting portion 7 formed of electrically insulating ceramics. Two lead portions (not shown) which extend from an anode plate (an anode portion) 8 extending in a direction perpendicular to an optical axis Y are caused to abut on the first supporting portion 7. Then, each lead portion is electrically connected to a distal end portion of a first stem pin (not shown) for an anode oriented upstanding on the stem 5 to extend in a direction of the optical axis Y. Thereby, a predetermined voltage is applied to the anode plate 8 via the first stem pin.

Further, the light emitting assembly 6 has a disc-like second supporting portion 10 formed of electrically insulating ceramics. The second supporting portion 10 is placed on the first supporting portion 7 so as to be stacked thereon, and it is formed to have a diameter equal to that of the first supporting portion 7. Further, a circular opening 9 is formed at a central portion of the second supporting portion 10, and the anode plate 8 which is circular is disposed in the opening 9. Then, the anode plate 8 is opposed to a second discharge path limit portion 11 made up of electrically conductive metal (for example, molybdenum, tungsten, or alloy made of these materials) inside the opening 9.

Furthermore, a flange portion 11*a* is provided on the second discharge path limit portion 11, and the flange portion 11*a* is welded to an electrically conductive plate 15 in a state where the second discharge path limit portion 11 has been inserted into a mounting port 15*a* of the electrically conductive plate 15 (refer to FIG. 3) Then, the electrically conductive plate 15 is fixed to the second supporting portion 10 by rivets 16 in a state where it has been caused to abut on an upper face of the second supporting portion 10. In addition, the electrically conductive plate 15 is electrically connected to a distal end portion of a stem pin (a second stem pin) 9*b*, oriented upstanding on the stem 5, for a discharge path limit portion.

Figure 3:
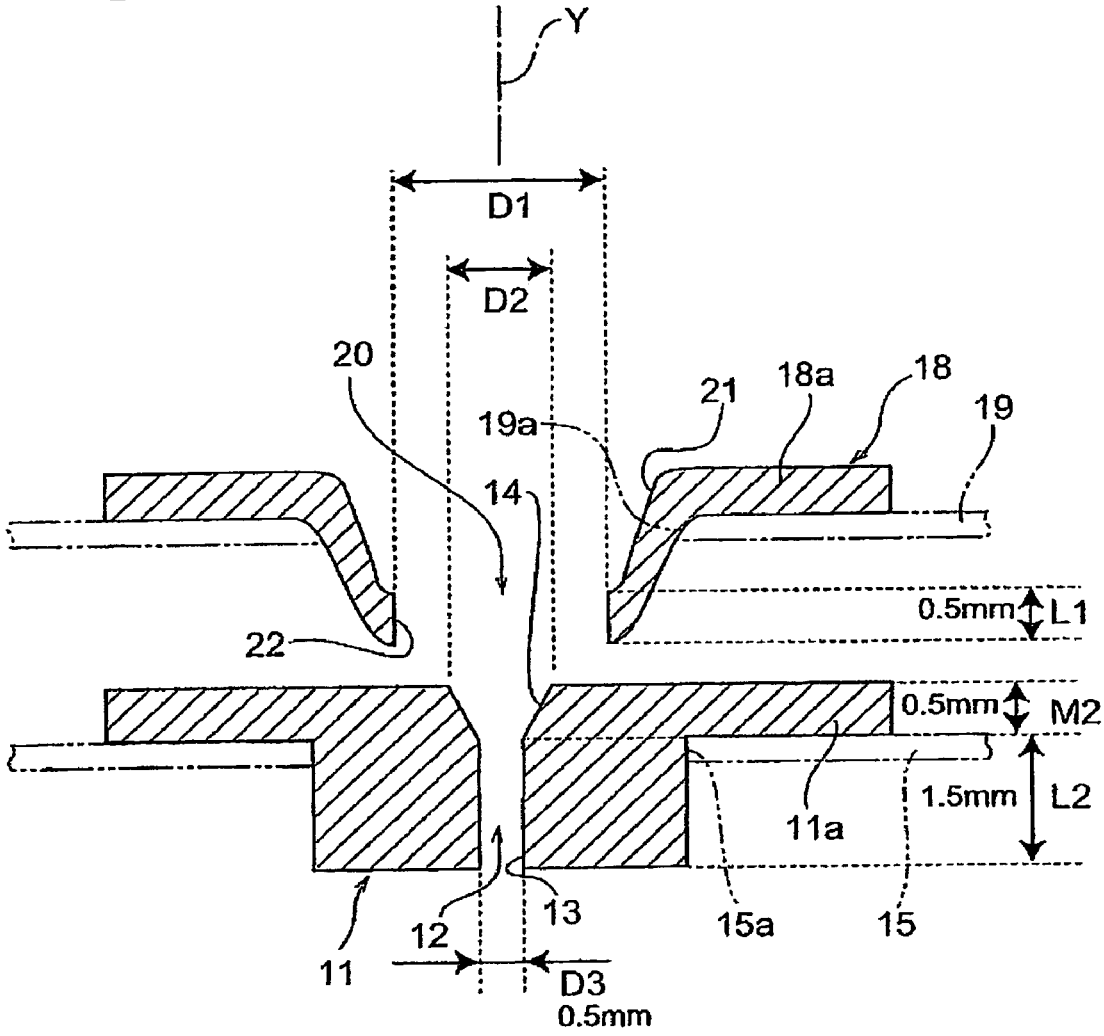
FIG. 3 is a sectional view showing a first discharge path limit portion and second discharge path limit portion which are applied to the gas discharge tube.

As shown in FIG. 3, a second opening 12 extending in the direction of the optical axis Y is provided at a central portion of the second discharge path limit portion 11, and the second opening 12 has a straight section 13 with a diameter of 0.5 mm for narrowing a discharge path. Further, the second opening 12 has a spread section 14 extending from an end portion of the straight section 13 toward a first opening 20 described later. That is, the spread section 14 is formed in a funnel shape constituting a truncated cone shape and it is reduced in diameter from the light-emitting window 4 toward the anode plate 8.

The length M of the spread section 14 is set equal to or less than the length L of the straight section 13. Thereby, an arc ball can be formed into a proper shape at the second opening 12, and sputtered material and evaporated material occurring from the spread section 14 can be reduced to the fullest extent. Further, the length L2 of the straight section 13 is set larger than the length L1 of the straight section 22 of the first discharge path limit portion 18. Thereby, a plasma density at the second discharge path limit portion 11 can be increased so that high luminance of light is achieved. In particular, it is preferable that the length L2 of the straight section 13 is larger than 1.0 mm. Thereby, the diameter of the straight section 13 on the side of the anode is prevented from being enlarged and a long life of the gas discharge tube 1 can be achieved. Specifically, it is preferable that, in case where the length M2 of the spread section 14 with an angle of opening about 60° is set to 0.5 mm and the length L1 of the straight section 22 of the first discharge path limit portion 18 is set to 0.5 mm, the length L2 of the straight section 13 is larger than 0.5 mm, for example, about 1.5 mm. Further, it is preferable that the length M2 of the spread section 14 is set equal to or larger than the diameter D3 of the straight section 13. Thereby, an arc ball produced at the second opening 12 can be formed into a further preferable shape. Specifically, it is preferable that, in case where the diameter D3 of the straight section 13 is set to 0.5 mm, the length M2 of the spread section 14 with an angle of opening about 60° is set to 0.5 mm or more, for example, about 1 mm.

Furthermore, the light emitting assembly 6 has a disc-like third supporting portion (an electrically insulating portion) 17 made up of electrically insulating ceramics. The third supporting portion 17 is placed on the second supporting portion 10 so as to be stacked thereon, and it is formed to have a diameter equal to that of the second supporting portion 10. Further, a circular opening 17*a* is formed at a central portion of the third supporting portion 17, and the first discharge path limit portion 18 opposed to the second discharge path limit portion 11 inside the opening 17*a* is made of electrically conductive metal (for example, molybdenum, tungsten, or alloy made of these materials).

A flange portion 18*a* is provided on the first discharge path limit portion 18, and the flange portion 18*a* is welded to an electrically conductive plate 19 in a state where the first discharge path limit portion 18 has been inserted into a mounting port 19*a* of the electrically conductive plate 19 (refer to FIG. 3). Then, the electrically conductive plate 19 is maintained in a state where it has been caused to abut on an upper face of the third supporting portion 17. Further, a peripheral edge portion of the electrically conductive plate 19 is welded to a stem pin (a third stem pin) for a discharge path limit portion, oriented upstanding on the stem 5.

As shown in FIG. 3, a first opening 20 for narrowing the discharge path is formed in such a first discharge path limit portion 18, and the first opening 20 is positioned on the same optical axis Y as the second opening 12. The first opening 20 has a straight section 22 and a funnel-shaped portion 21 extending in the direction of the optical axis Y for producing a stable arc ball. The funnel-shaped portion 21 is reduced in diameter from the light emitting window 4 toward the anode plate 8. It is preferable that the diameter of the opening of the funnel-shaped portion 21 on the side of the anode, namely, the diameter of the opening D1 of the straight section 22 is equal to or larger than the diameter D2 of the spread section 14 of the second discharge path limit portion 11 on the side of the light emitting window 4. Thereby, light originating in a plasma region or a region of high light emitting density formed in the spread section 14 can be taken out from the light-emitting window 4 without blocking conducted by the first discharge path limit portion 18. Specifically, the first opening 20 is formed in such a manner as to have a diameter of about 3.2 mm on the side of the light emitting window 4 formed in such a manner as to have a diameter of about 1.0 mm to 2.0 mm on the side of the anode plate 8. Further, in order to improve the starting properties, it is convenient that the length L1 of the straight section 22 is made shorter than the length L2 of the straight section 13 of the second discharge path limit portion 11 in the direction of the optical axis Y. For example, the length L1 of the straight section 22 is formed in such a manner as to have about 0.5 mm shorter than the length L2 of the straight section 13 of the second discharge path limit portion 11.

Further, a cathode 23 is disposed at a position deviated from the optical path on light emitting assembly 6 on the side of the light emitting window 4, and the cathode 23 is electrically connected to a fourth stem pin (not shown) for a cathode, oriented upstanding on the stem 5. The cathode 23 is received in a cap-shaped front cover 24, and the front cover 24 is welded and fixed to a third stem pin 9*c*. Furthermore, a circular light passing-through port 25 is formed in the front cover 24 at a position thereof opposed to the light emitting window 4.

Moreover, a discharge straightening plate 26 is provided inside the front cover 24 between the cathode 23 and the first discharge path limit portion 18 at a position deviated from the optical path. An electron emitting window 28 of the discharge straightening plate 26 is formed as a rectangular opening for allowing thermo electrons to pass there through, and is fixed to the electrically conductive plate 19 by welding. Thus, the cathode 23 is enclosed by the front cover 24 and the discharge straightening plate 26 so that sputtered material or evaporated material generated from the cathode 23 is prevented from adhering to the light-emitting window 4.

Next, an operation of the above-described gas discharge tube 1 will be explained briefly.

Power with about 10 W is supplied from an external power source to the cathode 23 via the fourth stem pin (not shown) for about 20 seconds before discharging is performed so that the cathode 23 is preheated. Thereafter, a voltage is applied between the cathode 23 and the anode plate 8 so as to generate a potential difference of about 160V there between to carry out the preparation for arc discharge.

Upon completion of the preparation, a trigger voltage is applied between the anode plate 8 and the second discharge path limit portion 11 from the external power source via the first stem pin (not shown) and the second stem pin 9*b* so as to generate a potential difference of about 350V there between. Thereby, discharge is generated between the cathode 23 and the second discharge path limit portion 11, so that discharge is sequentially generated between the cathode 23 and the anode plate 8. When such a starting discharge is generated, an arc discharging is maintained between the cathode 23 and the anode plate 8, whereupon arc balls are generated inside the first opening 20 and the second opening 12 which narrow the discharge path, respectively.

Second Embodiment

Explanation herein is confined for substantially different matters from the first embodiment, and constituent portions equal or equivalent to those in the first embodiment are denoted with the same reference numerals and explanation thereof will be omitted.

Figure 4:
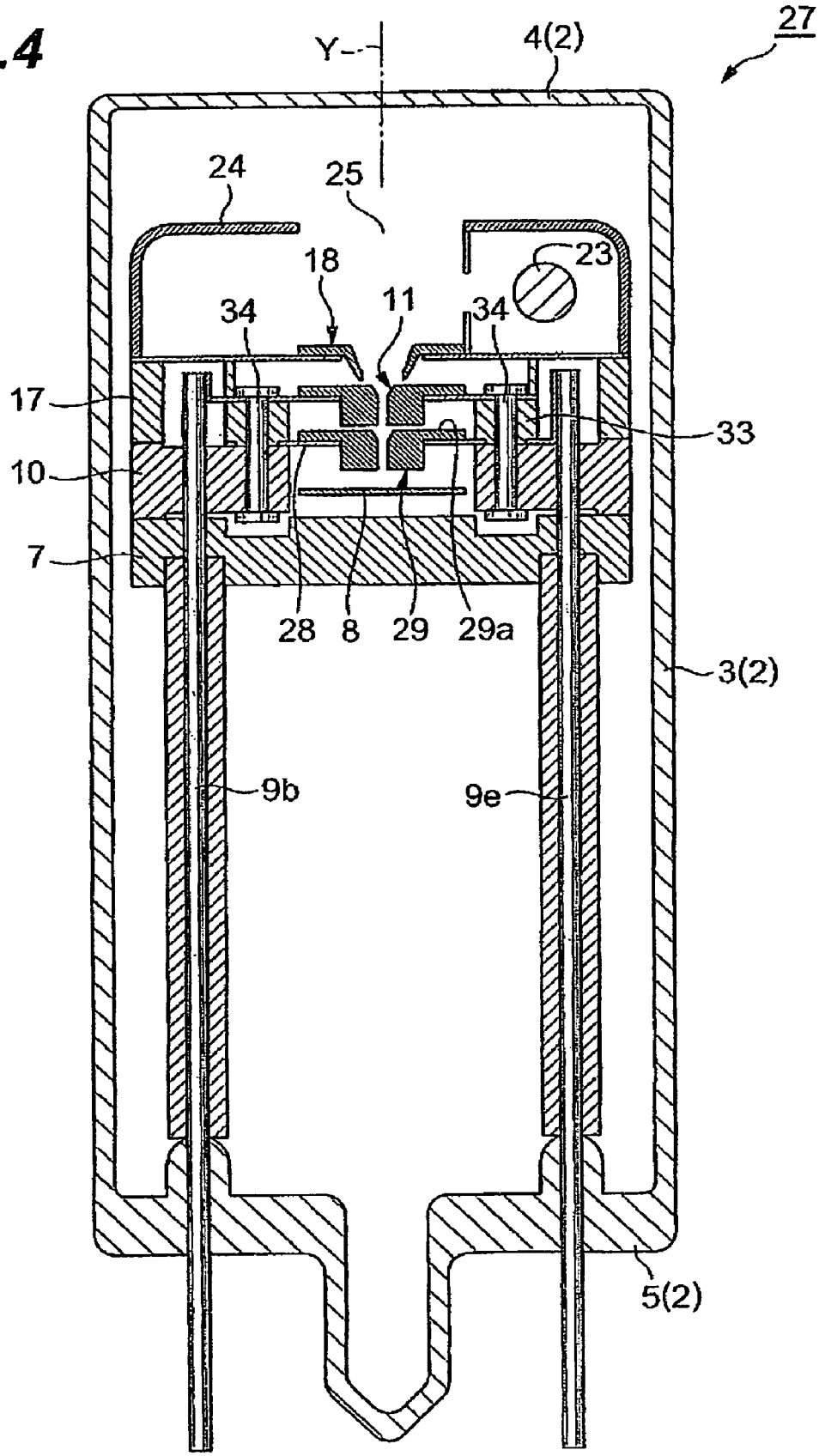
FIG. 4 is a sectional view showing a second embodiment of a gas discharge tube according to the present invention.
Figure 5:
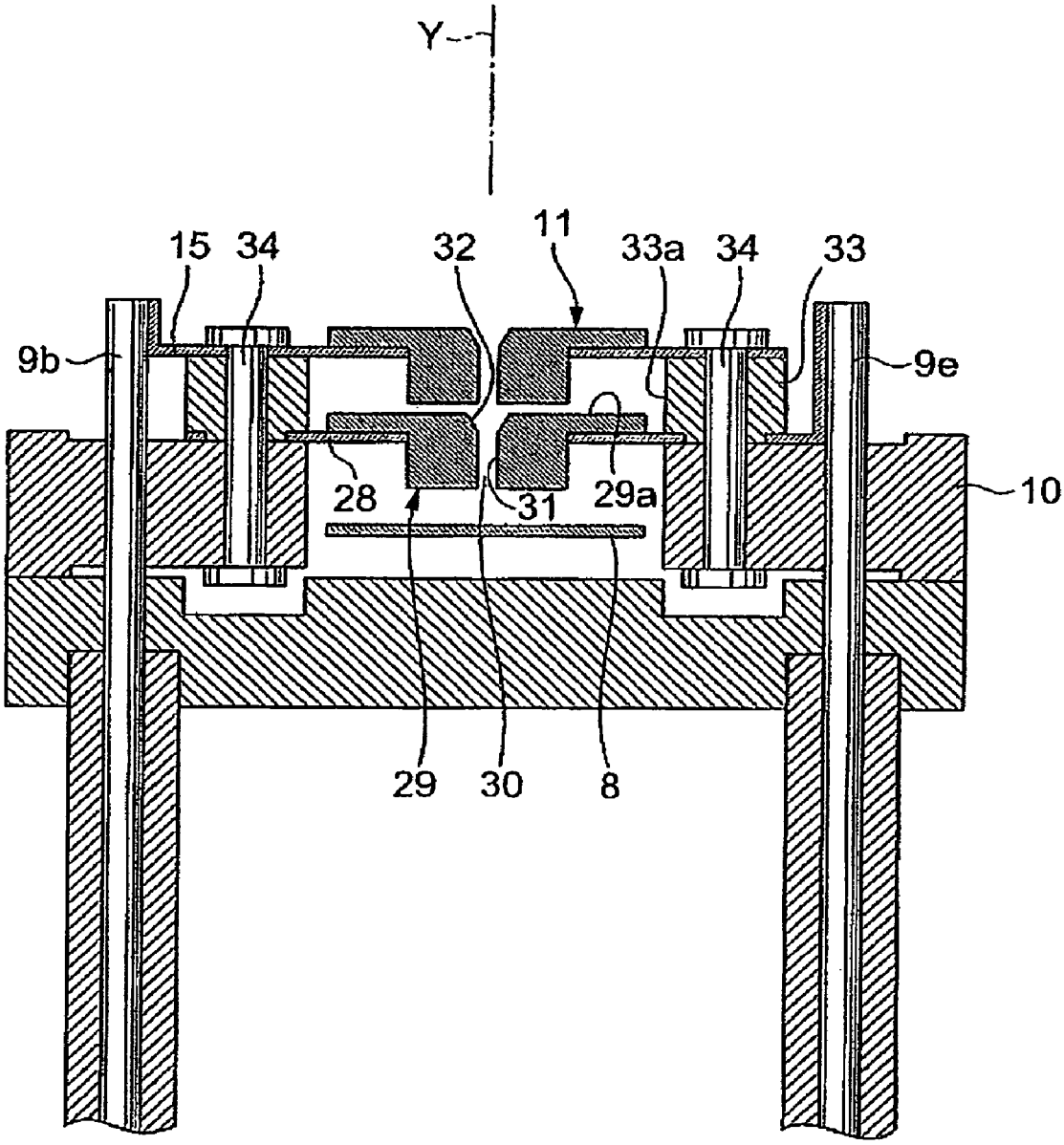
FIG. 5 is an enlarged sectional view of a main portion of the gas discharge tube shown in FIG. 4.

As shown in FIG. 4 and FIG. 5, a gas discharge tube 27 is a deuterium lamp of a head on type. In the gas discharge tube 27, a third discharge path limit portion 29 made up of electrically conductive metal (for example, molybdenum, tungsten, or alloy made of these materials) is disposed in a midway of the discharge path between the second discharge path limit portion 11 and the anode plate 8, and a flange portion 29*a* of the third discharge path limit portion 29 is welded to an electrically conductive plate 28.

Further, a third opening 30 extending in the direction of the optical axis Y is provided at a central portion of the third discharge path limit portion 29, and the third opening 30 has a straight section 31 with a diameter of 0.5 mm for narrowing the discharge path. Furthermore, the third opening 30 has a spread section 32 extending from an end portion of the straight section 31 toward the second opening 12. That is, the spread section 32 is formed in a funnel-like shape taking the shape of a truncated cone, and it is reduced in diameter from the light emitting window 4 toward the anode plate 8.

In addition, as the third discharge path limit portion 29, the same one as the second discharge path limit portion 11 is used. That is, the shape of the third opening 30 is identical to the shape of the second opening 12, and the length M2 of the spread section 32 is equal to or less than the length L2 of the straight section 31. (Refer to FIG. 3). Thereby, an arc ball can be formed into a proper shape at the third opening 30, and sputtered material and evaporated material generated from the spread section 32 can be reduced to the fullest extent.

Specifically, in case where the length M2 of the spread section 32 with an angle of opening about 60° is set to 0.5 mm, it is preferable that the length L2 of the straight section 31 is equal to or more than 0.5 mm, for example, about 1.5 mm. Further, it is preferable that the length M2 of the spread section 32 is set to be equal or larger than the diameter D3 of the straight section 31. Thereby, an arc ball produced at the third opening 30 is formed in a more favorable shape. Specifically, in case where the diameter D3 of the straight section 31 is set to 0.5 mm, it is preferable that the length M2 of the spread section 32 with an angle of opening about 60° is set to 0.5 mm or more, for example, about 1 mm.

Further, an electrical insulation is to be obtained by interposing a ring-like spacer (an electrically insulating portion) 33 made of electrical insulating ceramics between the electrically conductive plate 15 and the electrically conductive plate 28. Furthermore, a circular opening 33*a* is formed at a central portion of the spacer 33, and the electrically conductive plate 28 is sandwiched between the spacer 33 and the second supporting portion 10. Then, the electrically conductive plate 28 is fixed to the second supporting portion 10 by rivets 34 penetrating the spacer 33 and the second supporting portion 10. Further, the electrically conductive plate 15 is also fixed to the spacer 33 by the rivets 34.

Furthermore, in order to apply a voltage to the second discharge path limit portion 11, the electrically conductive plate 15 is electrically is connected to a distal end of the second stem pin 9*b* provided on the stem 5 oriented upstanding. On the other hand, in order to apply a voltage to third discharge path limit portion 29, the electrically conductive plate 28 is electrically connected to a distal end of a fifth stem pin 9*e* provided on the stem 5 oriented upstanding. The second discharge path limit portion 11 and the third discharge path limit portion 29 are electrically insulated from each other via the spacer 33 in this manner, so that the second discharge path limit portion 11 and the third discharge path limit portion 29 are set to have different potentials from each other and electrons are moved positively from the second discharge path limit portion 11 to the third discharge path limit portion 29.

Next, an operation of the above-described gas discharge tube 27 will be explained briefly.

Power with about 10 W is supplied from an external power source to the cathode 23 via the fourth stem pin (not shown) for about 20 seconds before discharging is performed so that the cathode 23 is preheated. Thereafter, a voltage is applied between the cathode 23 and the anode plate 8 so as to generate a potential difference of about 160V there between to arrange arc.

Upon completion of the preparation, a trigger voltage is applied between the anode plate 8 and the second discharge path limit portion 11 from the external power source via the first stem pin (not shown), the second stem pin 9*b* and the fifth stem pin 9*e* so as to generate a potential difference of about 350V there between. Thereby, discharge is generated between the cathode 23 and the second discharge path limit portion 11, so that discharges are sequentially generated between the cathode 23 and the third discharge path limit portion 29 and between the cathode 23 and the anode plate 8. When such a starting discharge is generated, an arc discharging is maintained between the cathode 23 and the anode plate 8, whereupon arc balls are generated inside the first opening 20, the second opening 12 and the third opening 30 which narrow the discharge path, respectively.

Third Embodiment

Figure 6:
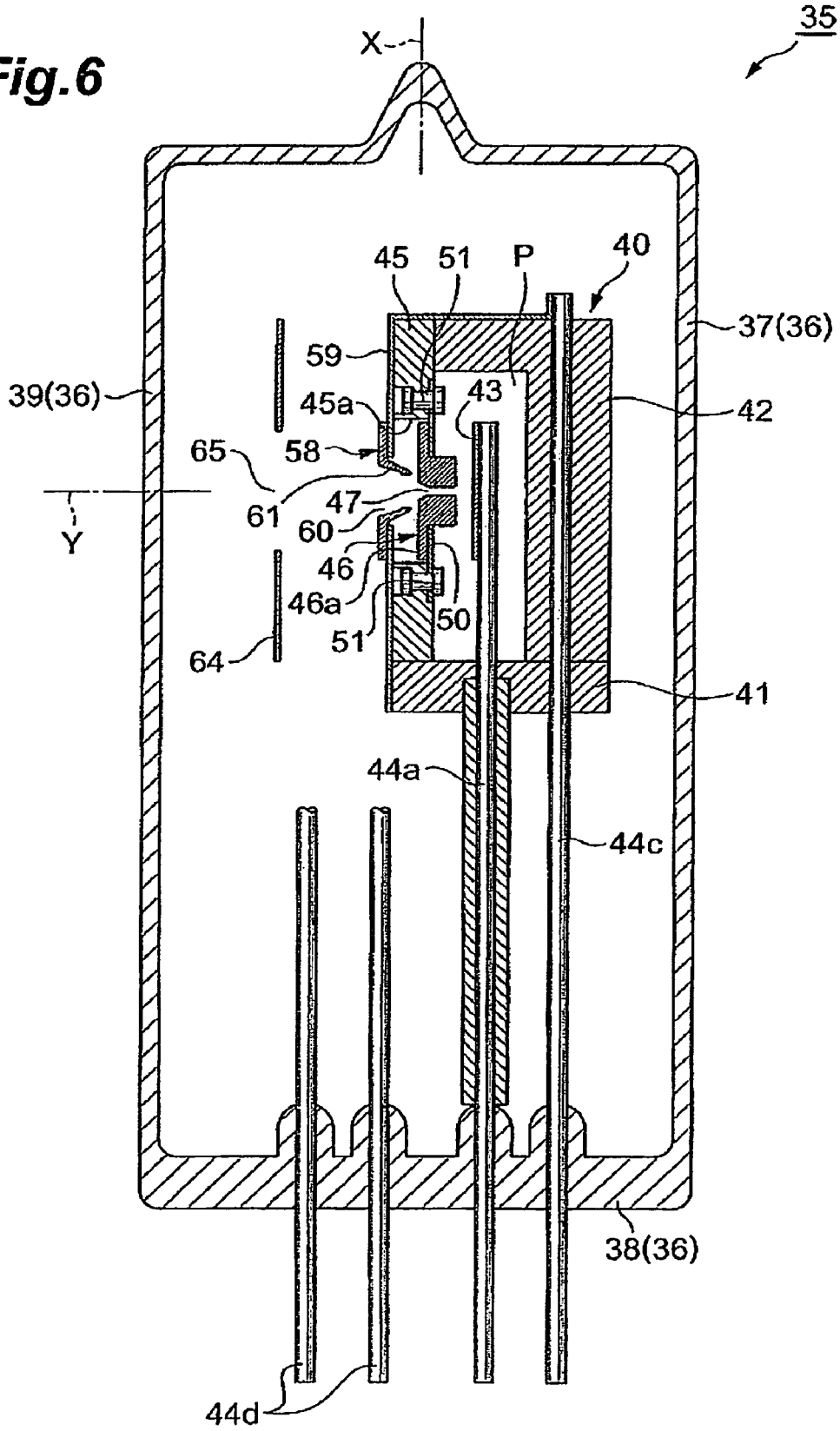
FIG. 6 is a sectional view showing a third embodiment of a gas discharge tube according to the present invention.
Figure 7:
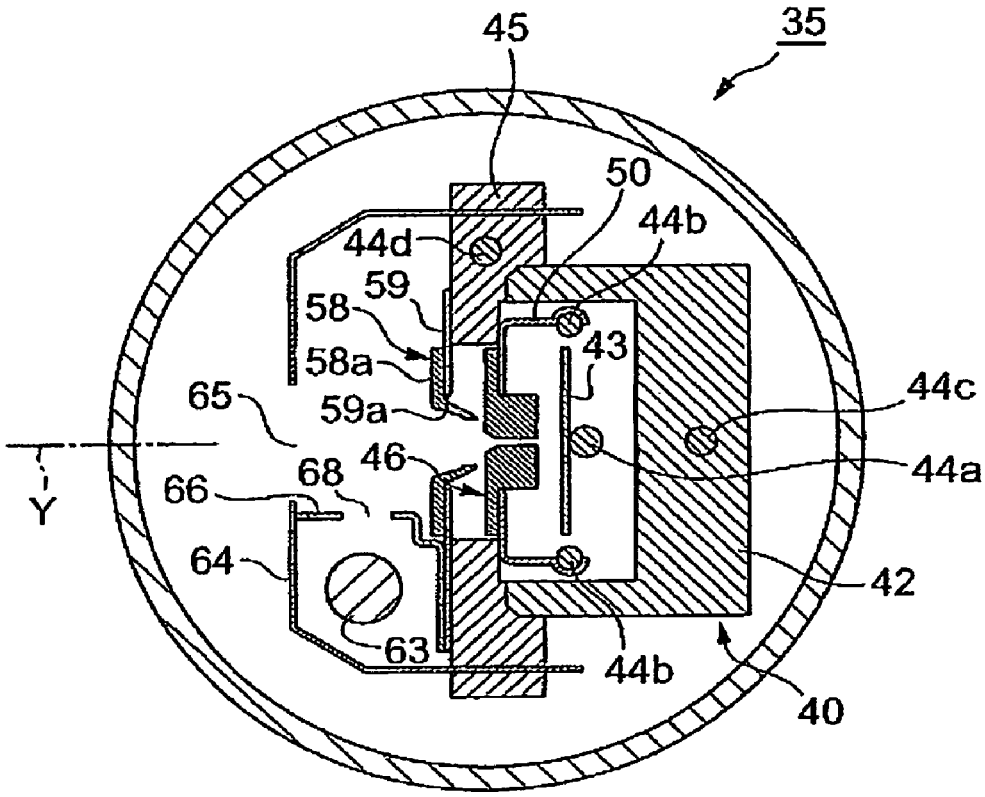
FIG. 7 is a transverse sectional view of the gas discharge tube shown in FIG. 6.

As shown in FIG. 6 and FIG. 7, a gas discharge tube 35 is a deuterium lamp of a side on type. The discharge tube 35 has a sealed envelope 36 made of glass in which deuterium gas has been enclosed in an amount of about several hundreds Pa. The sealed envelope 36 comprises a cylindrical side tube 37 whose one end has been sealed, and a stem 38 for sealing the other end of the side tube 37, and on portion of the side tube 37 is utilized as a light emitting window 39. Then, a light emitting assembly 40 is accommodated in the sealed envelope 36.

The light emitting assembly 40 has a first supporting portion 41 made of electrically insulating ceramics and a second supporting portion 42 made of electrically insulating ceramics, and a recessed portion P is formed on a front face with cooperation of the first supporting portion 41 and the second supporting portion 42. Then, an anode plate 43 is accommodated inside the recessed portion P. A back face of the anode plate 43 is electrically connected to a distal end portion of a first stem pin 44*a* for an anode oriented upstanding on the stem 38 to extend in a direction of a tube axis X.

Further, the light emitting assembly 40 has a third supporting portion 45 made of electrically insulating ceramics The third supporting portion 45 is caused to abut on a front face of the second supporting portion 42, and an opening 45*a* is formed at a central portion of the third supporting portion 45 in such a manner as to be opposed to the anode plate 43. Then, a second discharge path limit portion 46 made of electrically conductive metal (for example, molybdenum, tungsten, or alloy made of these materials) is disposed inside the opening 45*a*.

Figure 8:
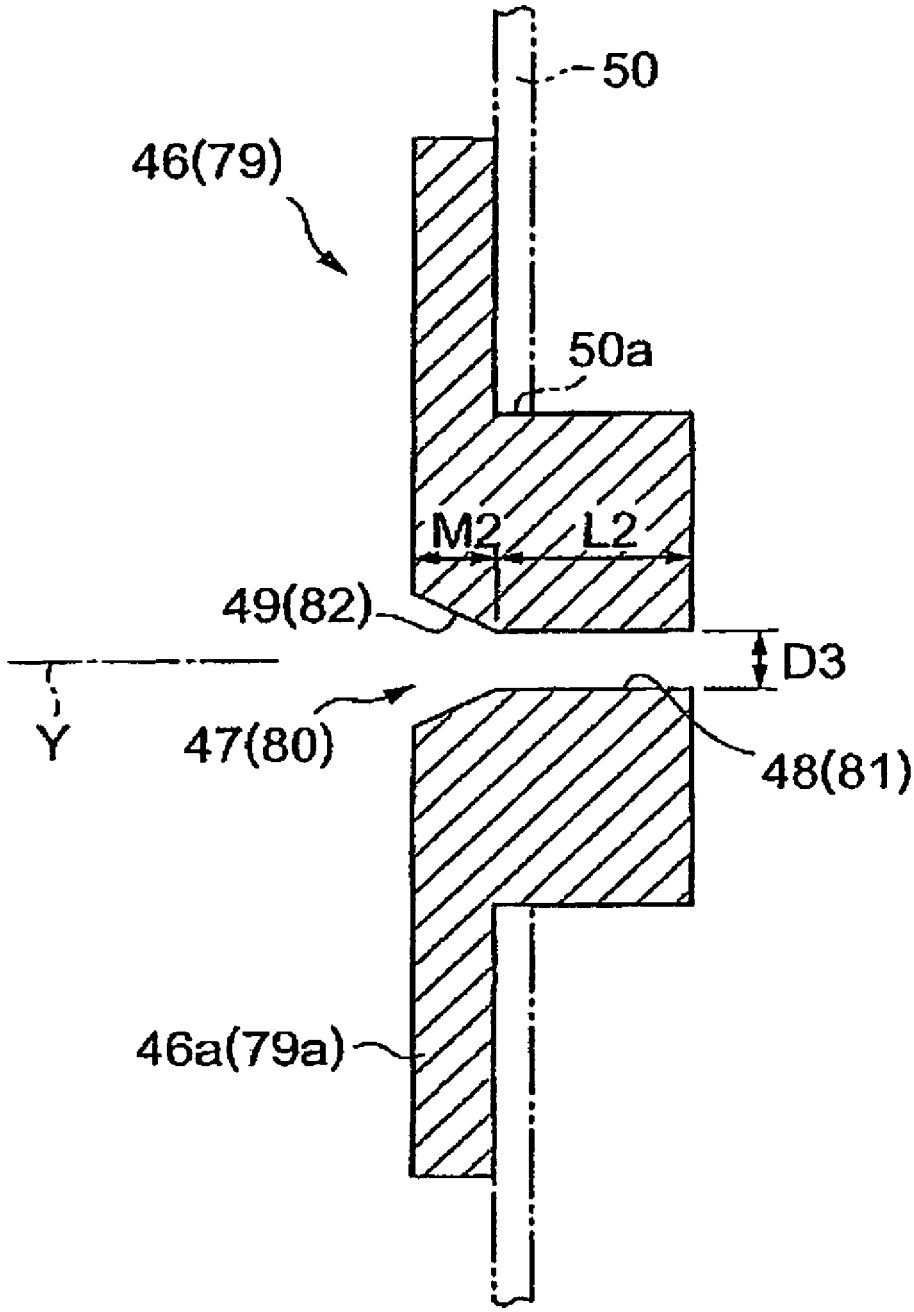
FIG. 8 is a sectional view showing a discharge path limit portion, which is applied to a gas discharge tube.

As shown in FIG. 8, a second discharge path limit portion 46 has a second opening 47 extending in the direction of an optical axis Y perpendicular to the tube axis X at a central portion thereof, and the second opening 47 has a straight section 48 with a diameter of 0.5 mm for narrowing discharge. Further, the second opening 47 has a spread section 49 extending from an end portion of the straight section 48 toward a first opening 60 described later. That is, the spread section 49 is formed in a funnel shape constituting a truncated cone shape and it is reduced in diameter from the light emitting window 39 toward the anode plate 43.

In addition, the length M2 of the spread section 49 is set to the length L2 of the straight section 48 or less. Thereby, an arc ball can be formed into a proper shape at the second opening 47, and sputtered material and evaporated material occurring from the spread section 49 can be reduced to the fullest extent. Specifically, in case where the length M2 of the spread section 49 with an angle of opening about 60° is set to 0.5 mm, it is preferable that the length L2 of the straight section 48 is set to 0.5 mm or more, for example, about 1.5 mm. Further, it is preferable that the length M2 of the spread section 49 is set equal to or greater than the diameter D3 of the straight section 48. Thereby, an arc ball produced at the second opening 47 can be formed in a favorable shape. Specifically, in case where the diameter D3 of the straight section 48 is set to 0.5 mm, it is preferable that the length M2 of the spread section 49 with an angle of opening about 60° is set to 0.5 mm or more, for example, about 1 mm.

Such a second discharge path limit portion 46 is provided with a flange portion 46*a*, and the flange portion 46*a* is welded to an electrically conductive plate 50 in a state where the second discharge path limit portion 46 has been inserted into a mounting port 50*a* of the electrically conductive plate 50. As shown in FIG. 6 and FIG. 7, then, the electrically conductive plate 50 is fixed to the third supporting portion 45 via rivets 51 in a state where the electrically conductive plate 50 has been caused to abut on a back face of the third supporting portion 45. Further, the electrically conductive plate 50 is electrically connected to a distal end of a stem pin (a second stem pin) 44*b* for a discharge path limit portion oriented upstanding on the stem 38.

Furthermore, a first discharge path limit portion 58 made of electrically conductive metal (for example, molybdenum, tungsten, or alloy made of these materials) is opposed to the second discharge path limit portion 46 inside the opening 45*a* of the third supporting portion 45. Further, the first discharge path limit portion 58 is provided with a flange portion 58*a*, and the flange portion 58*a* is welded to an electrically conductive plate 59 in a state where the first discharge path limit portion 58 has been inserted into a mounting port 59*a* of the electrically conductive plate 59. Then, the electrically conductive plate 59 is caused to abut on a front face of the third supporting portion 45 and the electrically conductive plate 59 is welded to a distal end of a stem pin (a third stem pin) 44*c* for a discharge path limit portion which penetrates the first supporting portion 41 and the second supporting portion 42 in the direction of the tube axis X.

Such a first discharge path limit portion 58 is formed with a first opening 60 for narrowing the discharge path, and the first opening 60 is positioned on the same optical axis Y as the second opening 47. The first opening 60 has a funnel-shaped portion 61, which extends in the direction of the optical axis Y to produce a stable arc ball, and the funnel-shaped portion 61 is reduced in diameter from the light emitting window 39 to the anode plate 43. Specifically, the first opening 60 is formed in such a manner as to have a diameter of about 3.2 mm on the side of the light emitting window 39 and is formed in such a manner as to have a diameter of about 1.0 mm to 2.0 mm on the side of the anode plate 43. Further, in order to improve the starting properties, it is preferable that the length of the first opening 60 is set to be shorter than the length L2 of the straight section 48 of the second discharge path limit portion 46 in the direction of the optical axis Y. For example, the length of the first opening 60 is formed in such a manner as to have about 0.5 mm, which is shorter than the length L2 of the straight section 48 of the second discharge path limit portion 46.

Further, a cathode 63 is disposed in the light emitting assembly 40 on the side of the light emitting window 39 at a position deviated from the optical path, the cathode 63 is electrically connected to a fourth stem pin 44*d* for a cathode provided on the stem 38 oriented upstanding, and the cathode 63 is received in a cap-shaped front cover 64. Both ends of the front cover 64 are inserted into the third supporting portion 45 and fixed thereto. Further, the front cover 64 is formed with a rectangular light passing-through port 65 at a position thereof opposed to the light emitting window 39.

Furthermore, a discharge straightening plate 66 is provided inside the front cover 64 at a position deviated from the optical path between the cathode 63 and the first discharge path limit portion 58. An electron discharge window 68 of the discharge straightening plate 66 is formed as a rectangular opening for allowing thermo electrons to pass, and it is fixed to the electrically conductive plate 59 by welding. The cathode 63 is enclosed by the front cover 64 and the discharge straightening plate 66 in this manner, so that sputtered material or evaporated material generated from the cathode 63 is prevented from adhering to the light emitting window 39.

Fourth Embodiment

Explanation herein is confined for substantially different matters from the third embodiment, and constituent portions equal or equivalent to those in the third embodiment are denoted with the same reference numerals and explanation thereof will be omitted.

Figure 9:
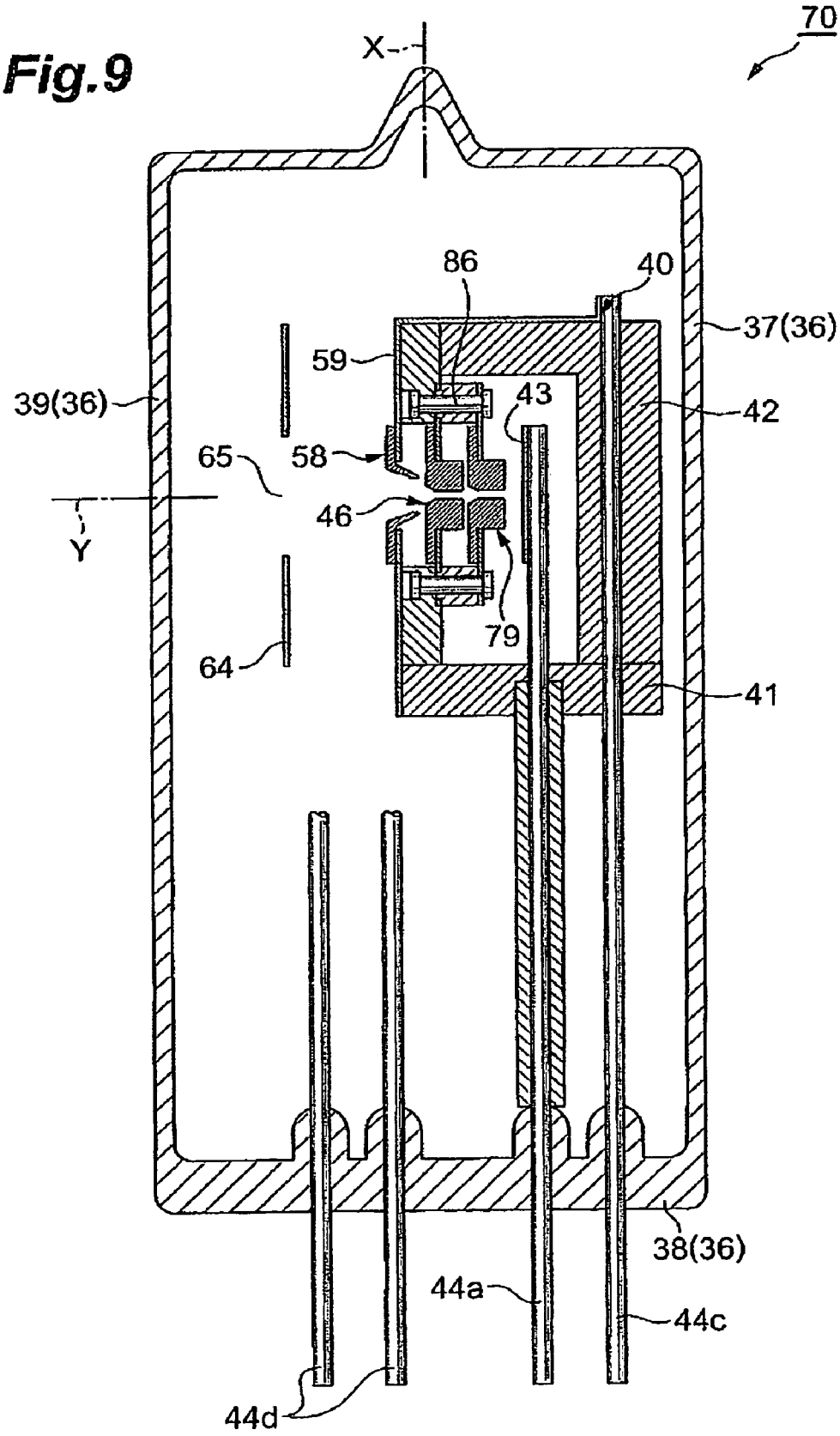
FIG. 9 is a sectional view showing a fourth embodiment of a gas discharge tube according to the present invention.
Figure 10:
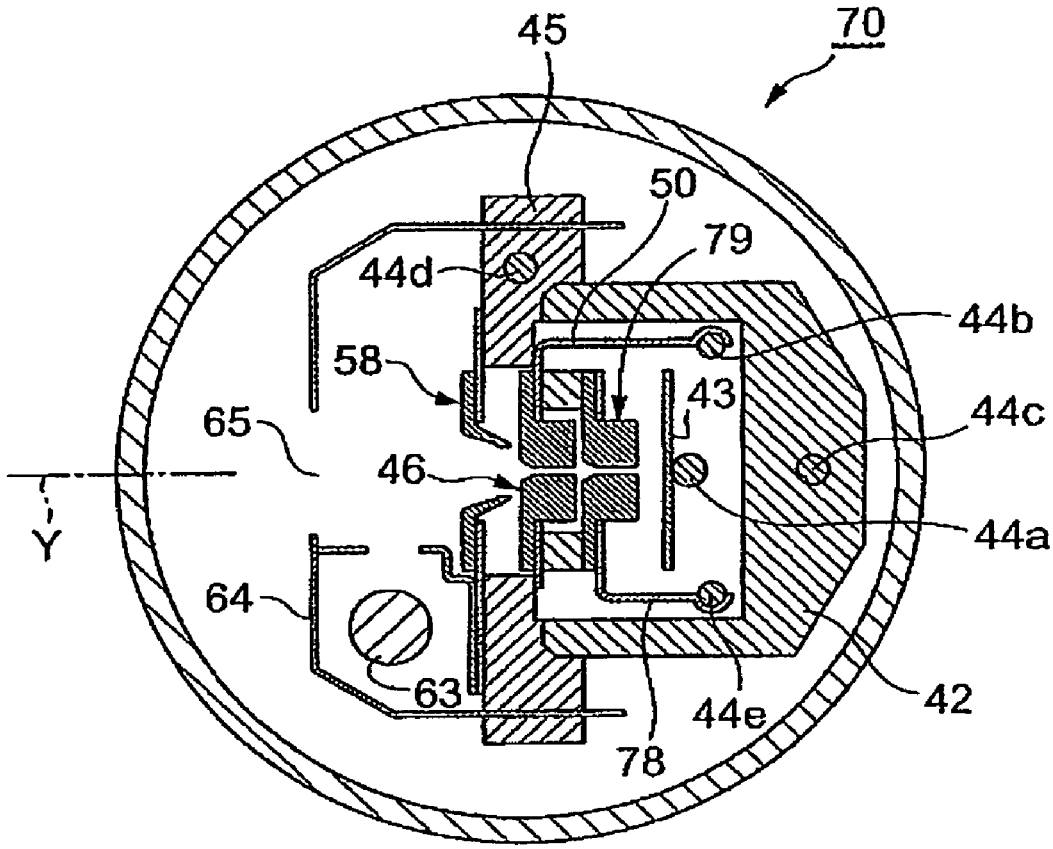
FIG. 10 is a transverse sectional view of the gas discharge tube shown in FIG. 9.
Figure 11:
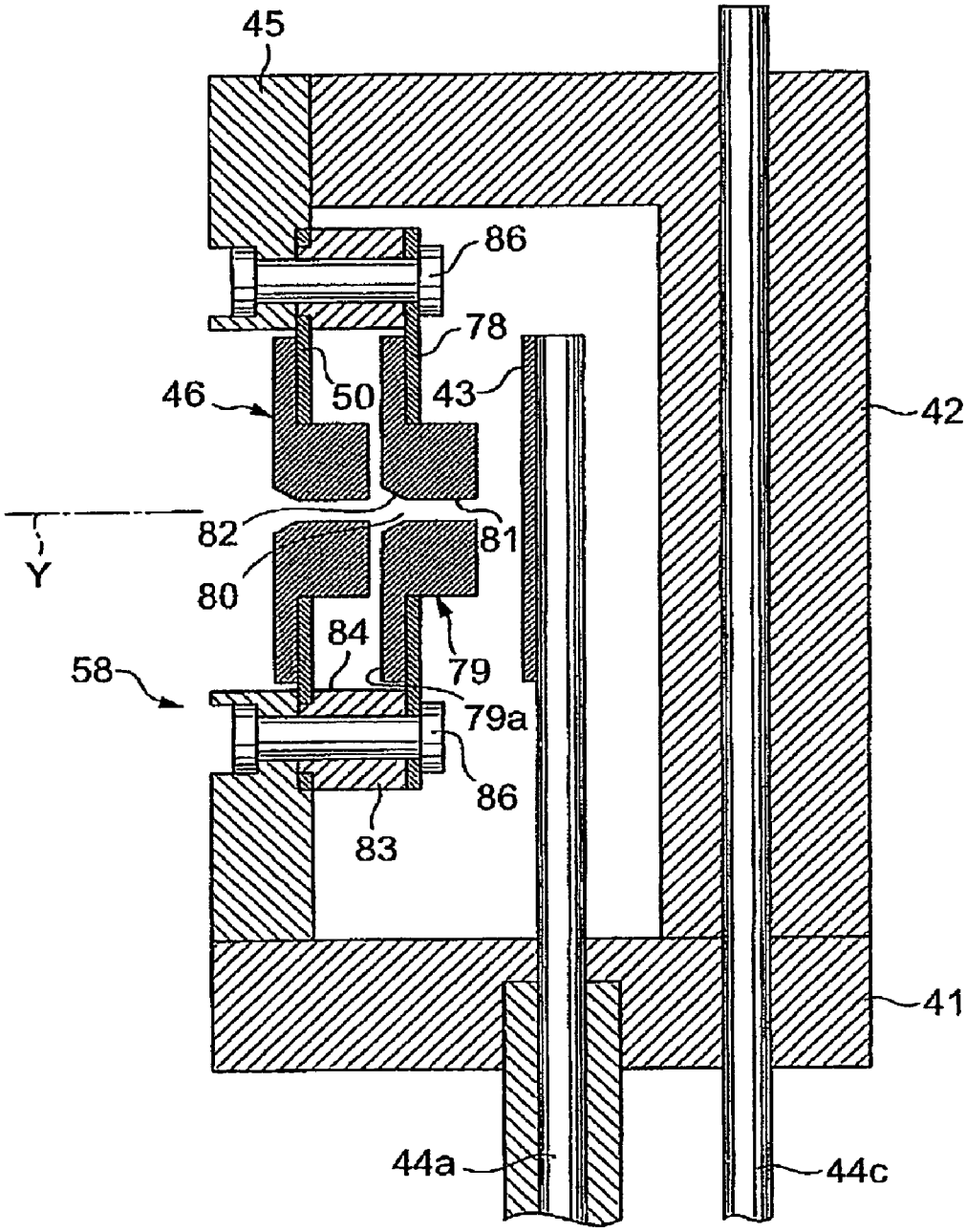
FIG. 11 is an enlarged sectional view of a main portion of the gas discharge tube shown in FIG. 9.

As shown in FIG. 9 to FIG. 11, a gas discharge tube 70 is a deuterium lamp of a side on type. In the gas discharge tube 70, a third discharge path limit portion 79 made up of electrically conductive metal (for example, molybdenum, tungsten, or alloy made of these materials) is disposed in a midway of the discharge path between a second discharge path limit portion 46 and an anode plate 43, and a flange portion 79*a* of the third discharge path limit portion 79 is welded to an electrically conductive plate 78.

Further, a third opening 80 extending in the direction of optical axis Y is provided at a central portion of the third discharge path limit portion 79, and the third opening 80 has a straight section 81 with a diameter of 0.5 mm for narrowing the discharge path. Moreover, the third opening 80 has a spread section 82 extending from an end portion of the straight section 81 toward the second opening 47. That is, the spread section 82 is formed in a funnel shape constituting a truncated cone shape and it is reduced in diameter from the light emitting window 39 toward the anode plate 43.

In addition, as the third discharge path limit portion 79, one identical to the second discharge path limit portion 46 is utilized. That is, the shape of the third opening 80 is identical to the shape of the second opening 47. The length M2 of the spread section 82 is set to be equal to or less than the length L2 of the straight section. (Refer to FIG. 8). Thereby, an arc ball can be formed into a proper shape at the third opening 80, and sputtered material and evaporated material generated from the spread section 82 can be reduced to the fullest extent.

Specifically, in case where the length M2 of the spread section 82 with an angle of opening about 60° is set to 0.5 mm, it is preferable that the length L2 of the straight section 81 is set to 0.5 mm or more, for example, about 1.5 mm. Further, it is preferable that the length M2 of the spread section 82 is set to be equal to or larger than the diameter D3 of the straight section 81. Thereby, an arc ball produced at the third opening 80 is formed in a further favorable shape. Specifically, in case where the diameter D3 of the straight shape portion 81 is set to 0.5 mm, it is preferable that the length M2 of the spread section 82 with an angle of opening about 60° is set to 0.5 mm or more, for example, about 1 mm.

Further, electrical insulation is performed by interposing a ring-like spacer (an electrically insulating portion) 83 made of electrically insulating ceramics between the electrically conductive plate 50 and the electrically conductive plate 78. Furthermore, a circular opening 84 is formed at a central portion of the spacer 83, and the electrically conductive plate 50 is sandwiched by the spacer 83 and the third supporting portion 45. Then, the electrically conductive plate 50 is fixed to a back face of the third supporting portion 45 by rivets 86 penetrating the spacer 83 and the third supporting portion 45. The electrically conductive plate 78 is also fixed to the back face of the spacer 83 by the rivets 86.

In addition, in order to apply a voltage to the second discharge path limit portion 46, the electrically conductive plate 50 is electrically connected to a distal end of a second stem pin 44*b* provided on the stem 38 oriented upstanding. On the other hand, in order to apply a voltage to the third discharge path limit portion 79, the electrically conductive plate 78 is electrically connected to a distal end of a fifth stem pin 44*e* provided on the stem 38 oriented upstanding. The second discharge path limit portion 46 and the third discharge path limit portion 79 are electrically insulated from each other via the spacer 83 in this manner, so that the second discharge path limit portion 46 and the third discharge path limit portion 79 are respectively set to different potentials and electrons can be positively moved from the second discharge path limit portion 46 to the third discharge path limit portion 79.

Figure 12:
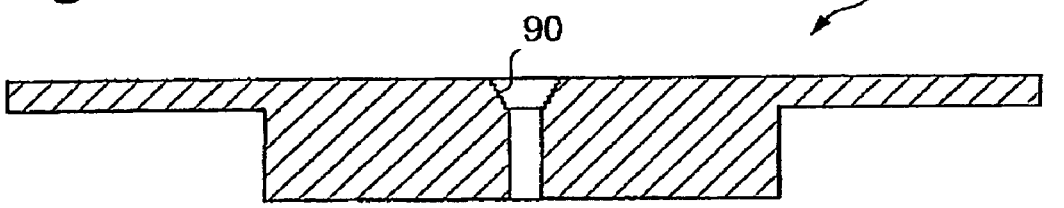
FIG. 12 is a sectional view of another example of the discharge path limit portion.
Figure 13:
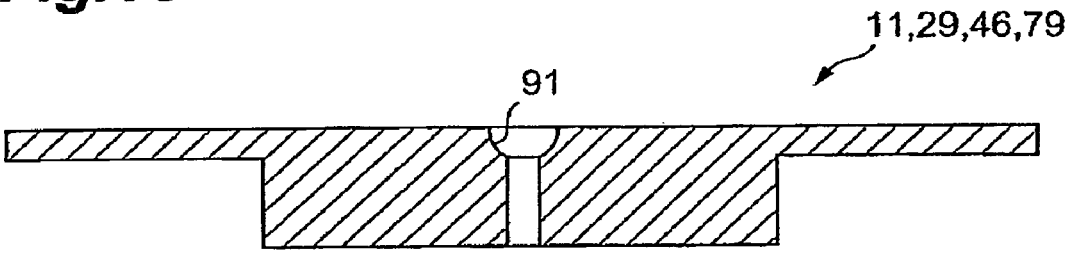
FIG. 13 is a sectional view of still another example of the discharge path limit portion.
Figure 14:
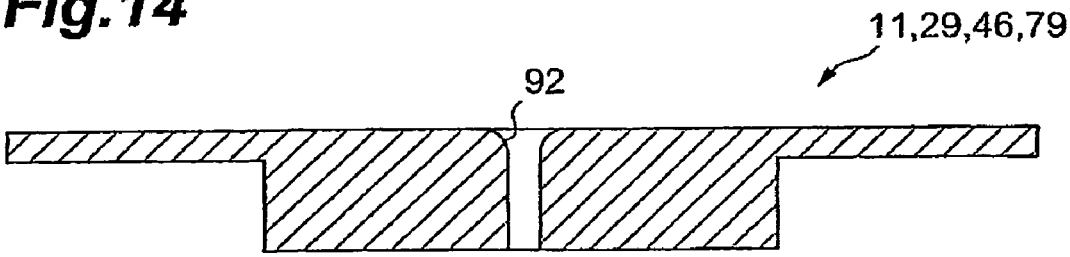
FIG. 14 is a sectional view of still another example of the discharge path limit portion.

The gas discharge tube according to the present invention is not limited to the various embodiments described above. For example, as shown in FIG. 12, surfaces of the spread sections on the second and the third discharge path limit portion s 11, 29, 46 and 79 described above may be provided with undulations 90. Further, as shown in FIG. 13, the surfaces of the spread sections on the second and the third discharge path limit portion s 11, 29, 46 and 79 described above may be formed as a semi-spherical face 91. As shown in FIG. 14, also, the surfaces of the spread sections on the second and the third discharge path limit portion s 11, 29, 46 and 79 described above may be formed as a chamfered portion 92 with a round shape.

Fifth Embodiment

Figure 15A:
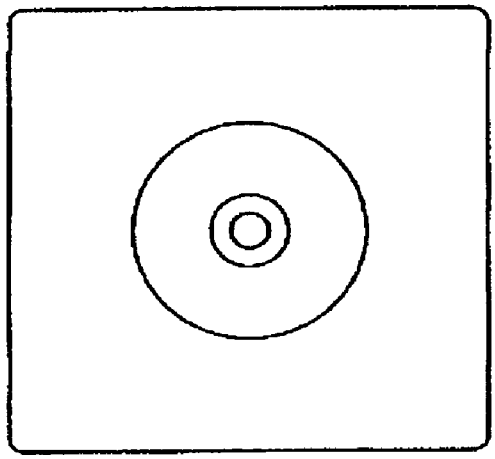
FIG. 15A is a front view of a discharge path limit portion N.
Figure 15B:
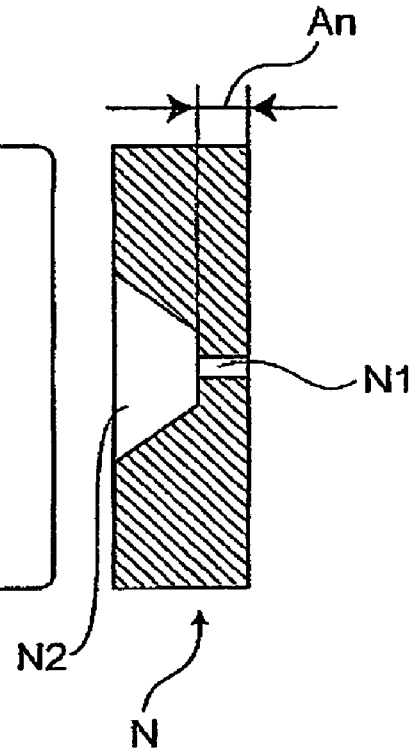
FIG. 15B is a sectional side view of the discharge path limit portion N.
Figure 16A:
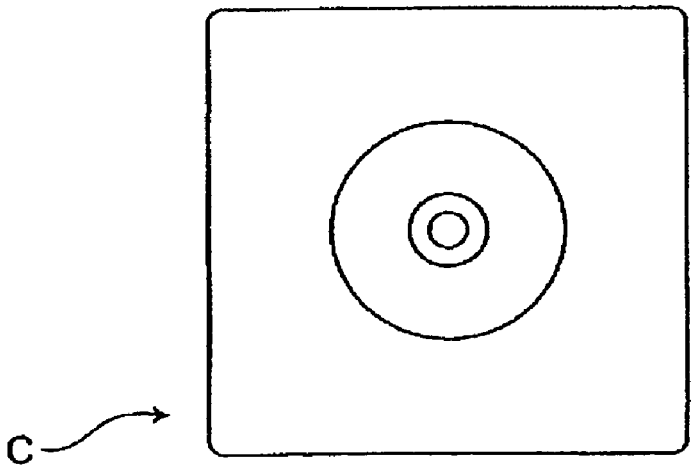
FIG. 16A is a front view of a conventional discharge path limit portion C manufactured by a press working
Figure 16B:
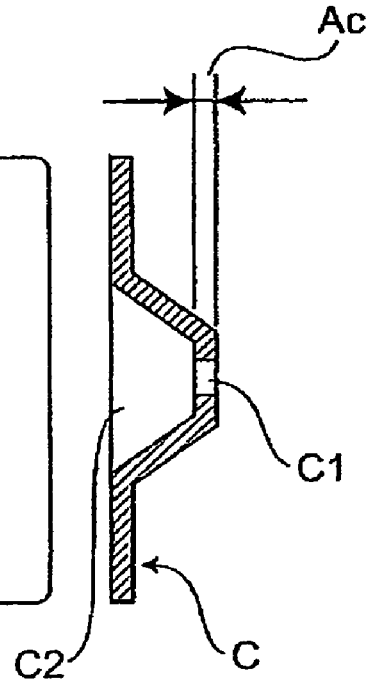
FIG. 16B is a sectional side view of the conventional discharge path limit portion C manufacturing by the press working.

A discharge path limit portion N of a fifth embodiment will be explained below. FIG. 15A is a front view of the discharge path limit portion N. FIG. 15B is a sectional side view of the discharge path limit portion N. FIG. 16A is a front view of a conventional discharge path limit portion C manufactured by press working. FIG. 16B is a sectional side view of the conventional discharge path limit portion C manufactured by press working. The discharge path limit portion N is a metal block provided with an opening comprising a straight section N1 having equal diameter along its lengthwise direction and an spread section N2 formed in a conical hole. The discharge path limit portion N is manufactured by molding metal material with a high melting point to sinter the same. Since the discharge path limit portion N is manufactured by such a manufacturing method, it is reduced in individual difference of shape, as compared with a conventional discharge path limit portion C manufactured by perform press working on a thin metal plate with a high melting point, and is suitable for mass production. Further, the discharge path limit portion N has a large degree of freedom regarding its shape. Specifically, in order to keep the shape of an arc ball excellent, it is possible to form the spread section N2 formed in a conical hole shape, and in order to achieve high intensity, it is possible to elongate a length An of the straight section N1. In the conventional discharge path limit portion C, the length Ac of a straight section C1 is limited by the thickness of a metal thin plate. On the other hand, in case where a metal thin plate with a thickness exceeding 0.5 mm is used in order to elongate the straight section C1, there is such a problem that, when an spread section C2 formed in a conical hole shape is intended to be formed by performing press work on the metal thin plate, a crack will occur. However, when sintering work is performed, the shape of the spread section is not limited, even if the straight section is elongated.

INDUSTRIAL APPLICABILITY

The present invention is applicable to, for example, a light source for a spectroscope or a chromatography.

In the gas discharge tube according to the present invention, there is carried out narrowing of the discharge path with cooperation of the first opening 20 and the second opening 12 in order to obtain higher luminance of light. Further, in order to maintain excellent starting-properties of a lamp even if the discharge path is narrowed, a predetermined voltage is applied to a second discharge path limit portion 11 externally. Thereby, a positive or active starting discharge is produced in such a manner as to pass through the first opening 20. Further, the second opening 12 is comprised of not only a straight section 13 extending in a direction of an optical axis Y, but also a spread section 14 extending from an end portion of the straight section 13 toward the first opening 20. The spread section 14 has a function of improving the starting properties of the lamp and forms an arc ball, and the straight section has a function of improving a plasma density. Thereby, discharge at a starting time is made easy to pass through the second discharge path limit portion 11. As a result, a rapid start of discharge between a cathode 23 and an anode portion 8 is achieved in the second discharge path limit portion 11, and that contributes to proper generation of an arc ball after lighting.

The invention claimed is:

1. A gas discharge tube wherein a gas is enclosed in a sealed envelope, and a light is emitted outward from a light emitting window of the sealed envelope by producing a discharge between an anode portion and cathode portion both disposed in the sealed envelope, comprising:

a first discharge path limit portion, arranged in a midway of a discharge path between the anode portion and the cathode portion, and provided with a first opening for narrowing the discharge path, the first opening having an entrance area and an exit area;

a second discharge path limit portion, arranged in a midway of the discharge path between the first discharge path limit portion and the anode portion, and provided with a second opening having a straight section for narrowing the discharge path a diameter of which is constant and which extends in a direction of an optical axis, and a spread section a diameter of which increases in size from an end of the straight section on the side of the cathode portion toward the first opening and which extends in the direction of the optical axis, the diameter of the exit area of the first opening being larger than the diameter of the straight section of the second opening.

2. The gas discharge tube according to claim 1, wherein the length of the straight section pertaining to the second discharge path limit portion is larger than the length of the spread section in the direction of the optical axis.

3. The gas discharge tube according to claim 1, wherein the length of the spread section in the direction of the optical axis is equal to or larger than the diameter of the straight section.

4. The gas discharge tube according to claim 1, wherein the first opening of the first discharge path limit portion has a spread section extending in the direction of the optical axis in such a manner that the diameter of the spread section on the side of the cathode portion is larger than the diameter thereof on the side of the anode portion.

5. The gas discharge tube according to claim 1, wherein the length of the straight section of the second opening is set larger than 1.0 mm in the direction of the optical axis.

6. The gas discharge tube according to claim 1, wherein an electrically insulating portion is disposed between the first discharge path limit portion and the second discharge path limit portion.

7. The gas discharge tube according to claim 1, further comprising a third discharge path limit portion, disposed in a midway of the discharge path between the second discharge path limit portion and the anode portion, and provided with a third opening for narrowing the discharge path.

8. The gas discharge tube according to claim 7, wherein the third opening has a straight section for narrowing the discharge path a diameter of which is constant and which extends in a direction of the optical axis, and a spread section a diameter of which increases in size from an end of the straight section on the side of the cathode portion toward the second opening and which extends in the direction of the optical axis.

9. The gas discharge tube according to claim 8, wherein the length of the straight section of the third discharge path limit portion is set larger than a length of the spread section of the third discharge path limit portion.

10. The gas discharge tube according to claim 8, wherein the length of the spread section of the third discharge path limit portion in the direction of the optical axis is equal to or larger than the diameter of the straight section of the third discharge path limit portion.

11. The gas discharge tube according to claim 7, wherein an electrically insulating portion is disposed between the second discharge path limit portion and the third discharge path limit portion.

12. The gas discharge tube according to claim 1, wherein the first opening of the first discharge path limit portion has an spread section extending in the direction of the optical axis and a straight section extending from the spread section in the direction of the optical axis and the straight section of the first discharge path limit portion is located out of the spread section of the second discharge path limit portion.

13. A gas discharge tube wherein a gas is enclosed in a sealed envelope, and a light is emitted outward from a light emitting window of the sealed envelope by producing a discharge between a anode portion and cathode portion both disposed in the sealed envelope, comprising:

a first discharge path limit portion, arranged in a midway of a discharge path between the anode portion and the cathode portion, and provided with a first opening for narrowing the discharge path;

a second discharge path limit portion, arranged in a midway of the discharge path between the first discharge-path limit portion and the anode portion, and provided with a second opening having a straight section for narrowing the discharge path a diameter of which is constant and which extends in a direction of an optical axis, and a spread section a diameter of which increases in size from an end of the straight section on the side of the cathode portion toward the first opening and which extends in the direction of the optical axis, wherein the diameter of the first opening of the first discharge path limit portion on the side of the anode portion is larger than the diameter of the spread section pertaining to the second discharge path limit portion on the side of the first opening.

14. The gas discharge tube according to claim 13, wherein the length of the straight section pertaining to the second discharge path limit portion is larger than the length of the spread section in the direction of the optical axis.

15. The gas discharge tube according to claim 13, wherein the length of the spread section in the direction of the optical axis is equal to or larger than the diameter of the straight section.

16. The gas discharge tube according to claim 13, wherein the first opening of the first discharge path limit portion has an spread section extending in the direction of the optical axis in such a manner that the diameter of the spread section on the side of the cathode portion is larger than the diameter thereof on the side of the anode portion.

17. The gas discharge tube according to claim 13, wherein the first opening of the first discharge path limit portion further comprises a straight section, for narrowing the discharge path, extending in the direction of the optical axis from an end of the first opening on the anode side with a constant diameter, and the length of the straight section of the second opening is set larger than the length of the straight section of the first opening in the direction of the optical axis.

18. The gas discharge tube according to claim 13, wherein the length of the straight section of the second opening is set larger than 1.0 mm in the direction of the optical axis.

19. The gas discharge tube according to claim 13, wherein an electrically insulating portion is disposed between the first discharge path limit portion and the second discharge path limit portion.

20. The gas discharge tube according to claim 13, further comprising a third discharge path limit portion, disposed in a midway of the discharge path between the second discharge path limit portion and the anode bportion, and provided with a third opening for narrowing the discharge path.

21. The gas discharge tube according to claim 20, wherein the third opening has a straight section for narrowing the discharge path a diameter of which is constant and which extends in a direction of the optical axis, and a spread section a diameter of which increases in size from an end of the straight section on the side of the cathode portion toward the second opening and which extends in the direction of the optical axis.

22. The gas discharge tube according to claim 21, wherein the length of the straight section of the third discharge path limit portion is set larger than a length of the spread section of the third discharge path limit portion.

23. The gas discharge tube according to claim 21, wherein the length of the spread section of the third discharge path limit portion in the direction of the optical axis is equal to or larger than the diameter of the straight section of the third discharge path limit portion.

24. The gas discharge tube according to claim 20, wherein an electrically insulating portion is disposed between the second discharge path limit portion and the third discharge path limit portion.

25. A gas discharge tube wherein a gas is enclosed in a sealed envelope, and a light is emitted outward from a light emitting window of the sealed envelope by producing a discharge between a anode portion and cathode portion both disposed in the sealed envelope, comprising:

a first discharge path limit portion, arranged in a midway of a discharge path between the anode portion and the cathode portion, and provided with a first opening for narrowing the discharge path;

a second discharge path limit portion, arranged in a midway of the discharge path between the first discharge path limit portion and the anode portion, and provided with a second opening having a straight section for narrowing the discharge path a diameter of which is constant and which extends in a direction of an optical axis, and a spread section a diameter of which increases in size from an end of the straight section on the side of the cathode portion toward the first opening and which extends in the direction of the optical axis wherein the first opening of the first discharge path limit portion further comprises a spread section and a straight section, for narrowing the discharge path, extending in the direction of the optical axis from an end of the first opening on the anode side with a constant diameter, and the length of the straight section of the second opening is set larger than the length of the straight section of the first opening in the direction of the optical axis.

26. The gas discharge tube according to claim 25, wherein the length of the straight section of the second opening is set larger than 1.0 mm in the direction of the optical axis.

27. The gas discharge tube according to claim 25, wherein an electrically insulating portion is disposed between the first discharge path limit portion and the second discharge path limit portion.

28. The gas discharge tube according to claim 25, further comprising a third discharge path limit portion, disposed in a midway of the discharge path between the second discharge path limit portion and the anode portion, and provided with a third opening for narrowing the discharge path.

29. The gas discharge tube according to claim 28, wherein the third opening has a straight section for narrowing the discharge path a diameter of which is constant and which extends in a direction of the optical axis, and a spread section a diameter of which increases in size from an end of the straight section on the side of the cathode portion toward the second opening and which extends in the direction of the optical axis.

30. The gas discharge tube according to claim 29, wherein the length of the straight section of the third discharge path limit portion is set larger than a length of the spread section of the third discharge path limit portion.

31. The gas discharge tube according to claim 29, wherein the length of the spread section of the third discharge path limit portion in the direction of the optical axis is equal to or larger than the diameter of the straight section of the third discharge path limit portion.

32. The gas discharge tube according to claim 28, wherein an electrically insulating portion is disposed between the second discharge path limit portion and the third discharge path limit portion.

33. The gas discharge tube according to claim 25, wherein the length of the straight section pertaining to the second discharge path limit portion is larger than the length of the spread section in the direction of the optical axis.

34. The gas discharge tube according to claim 25, wherein the length of the spread section in the direction of the optical axis is equal to or larger than the diameter of the straight section.

35. The gas discharge tube according to claim 25, wherein the first opening of the first discharge path limit portion has an spread section extending in the direction of the optical axis in such a manner that the diameter of the spread section on the side of the cathode portion is larger than the diameter thereof on the side of the anode portion.

36. The gas discharge tube according to claim 25, wherein the diameter of the first opening of the first discharge path limit portion on the side of the anode portion is larger than the diameter of the spread section pertaining to the second discharge path limit portion on the side of the first opening.

37. The gas discharge tube according to claim 25, wherein the straight section of the first discharge path limit portion is location out of the spread section of the second discharge path limit portion.

* * * * *